United States Patent [19]

Nohe et al.

[11] 3,984,294

[45] Oct. 5, 1976

[54] ELECTROCHEMICAL MANUFACTURE OF PINACOL

[75] Inventors: Heinz Nohe, Meckenheim; Fritz Beck, Ludwigshafen; Dietmar Werner, Weisenheim; Ernst-Jüergen Schier, Ludwigshafen, all of Germany

[73] Assignee: BASF Aktiengesellschaft, Ludwigshafen (Rhine), Germany

[22] Filed: Aug. 28, 1974

[21] Appl. No.: 501,043

[30] Foreign Application Priority Data

Sept. 8, 1973 Germany .....2345461

[52] U.S. Cl. ..... 204/77; 204/75; 204/76

[51] Int. Cl.[2] ..... C25B 3/04; C25B 11/04

[58] Field of Search ..... 204/76, 77, 59 R, 75

[56] References Cited

UNITED STATES PATENTS

| | | | |
|---|---|---|---|
| 3,193,482 | 7/1965 | Baizeo | 204/73 R |
| 3,485,726 | 12/1969 | Misorro | 204/73 R |
| 3,497,430 | 2/1970 | French et al. | 204/77 |
| 3,899,401 | 8/1975 | Nohe et al. | 204/59 R |

FOREIGN PATENTS OR APPLICATIONS

| | | | |
|---|---|---|---|
| 113,719 | 9/1900 | Germany | 204/77 |

*Primary Examiner*—F.C. Edmundson
*Attorney, Agent, or Firm*—Johnston, Keil, Thompson & Shurtleff

[57] ABSTRACT

Pinacol is manufactured by electrolytic hydrodimerization of acetone in a compartmented cell using a catholyte which contains from 10 to 90% by weight of acetone, from 1 to 60% by weight of water and from 1 to 50% by weight of a quaternary ammonium salt.

8 Claims, No Drawings

ELECTROCHEMICAL MANUFACTURE OF PINACOL

This application discloses and claims subject matter described in German Patent Application 2345461, filed Sept. 8, 1973. which is incorporated herein by reference.

the invention is concerned with a new and particularly advantageous process for the electrochemical manufacture of pinacol.

It is known that organic carbonyl compounds, especially aldehydes and ketones, can be dimerized, with simultaneous hydrogenation, to the so-called pinacols, that is to say to derivatives of alkylene glycol.

This hydrodimerization can only be carried out electrochemically on a cathode whose hydrogen overvoltage is not too low, or by means of a suitable reducing agent. It cannot be carried out under catalytic hydrogenation conditions. Photochemical synthesis of the pinacols proves rather unsatisfactory, in particular with regard to the energy yield. In the electrochemical synthesis of pinacol, the hydrogen is provided by the protons of the solvent or of an added acid:

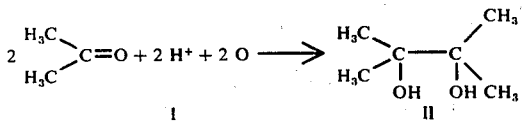

I II

It is also known that the formation of pinacols from aromatic or aromatic/aliphatic carbonyl compounds gives high yields, whilst only moderate to poor yields of the pinacol are to be expected with purely aliphatic compounds.

This situation is related to the stability of the radical intermediates.

Starting from acetone, tetramethylethylene glycol, referred to as "pinacol," is obtained. This compound is converted into pinacolene or into 2,3-dimethylbutadiene by acid-catalyzed elimination of one or two molecules of water, respectively.

Both these products derived directly from pinacol, and pinacol itself, are interesting intermediates for the synthesis of polymers, pharmaceuticals and pesticides. However, broad use of these products has hitherto been prevented by the fact that only unsatisfactory methods of manufacture were available.

One proces for the manufacture of pinacol consists, for example, in reacting acetone with amalgams of aluminum, magnesium or sodium. This process is still being used to manufacture pinacol on a small scale. The process produces a great deal of isopropanol as a by-product and the degree of utilization of the metal is relatively low, so that costs are high. Furthermore, the salts produced are an objectionable ballast. Whilst the last-mentioned disadvantage is avoided in direct electro-reduction on lead, lead-copper alloy or lead-tin alloy cathodes in electrolytes containing sulfuric acid or in alkaline electrolytes, this process has not found industrial acceptance, for example because it suffers from various disadvantages. Thus, the formation of highly toxic lead-organyls ("lead oils") as by-products at the cathode cannot be avoided. In addition, only poor current efficiencies are attainable. Further, the electrolyte has to be neutralized before working up, to prevent the acid-catalyzed elimination of water to give pinacolene or dimethylbutadiene, and this neutralization produces large amounts of salts. It is also a disadvantage that some of the acetone is reduced to the valueless by-product isopropanol and that the solutions contain a large amount of water which must in part be evaporated during working up.

It is an object of the present invention to develop a direct electrochemical process for the manufacture of pinacol from acetone, which avoids the above disadvantages. This object is achieved by the process according to the invention.

According to the process of the invention, pinacol is manufactured by electrolytic hydrodimerization of acetone in a compartmented cell, using for the electrolysis a catholyte which contains from 10 to 90% by weight of acetone, from 1 to 60% by weight of water and from 1 to 50% by weight of a quaternary ammonium salt.

The cell used is a compartmented cell. Suitable partitions are porous diaphragms, but especially cation exchange membranes of the type of sulfonated cross-linked polystyrene.

A suitable anode is lead coated with lead dioxide, or graphite or titanium, especially in conjunction with sulfuric acid of from 1 to 10% strength as the anolyte.

The catholyte contains from 10 to 90% by weight, and preferably from 40 to 80% by weight, of acetone, from 1 to 60% by weight, preferably from 5 to 40% by weight, of water and from 1 to 50% by weight, preferably from 5 to 20% by weight, of a quaternary ammonium salt.

Examples of suitable quaternary ammonium salts are compounds of the formula

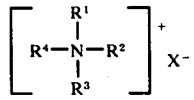

in which the radicals R are alkyl, such as alkyl of 1 to 6 carbon atoms, for example methyl, ethyl, n-propyl, i-propyl, n-butyl, aryl, such as phenyl, and aralkyl, such as benzyl, and $X^-$ is an anion, for example a sulfate, alkyl-sulfate, phosphate, carbonate, arylsulfonate, such as tosylate, tetrafluoborate, hexafluosilicate, halide and perchlorate anion.

Particularly suitable conducting salts are tetraethylammonium ethyl-sulfate, tetraethylammonium p-toluenesulfonate, tetraethylammonium sulfate and tetrabutylammonium sulfate and tetrabutylammonium sulfate and tetrabutylammonium tetrafluoborate. Within the stated range, the concentration of these salts should be kept as low as possible to simplify the isolation of the pinacol and avoid its anodic degradation.

In principle, it is possible to employ as the cathode material any metal of medium or high hydrogen overvoltage, that is say Cu, Ag, Cd, Zn, Sn, Pb, Tl and Hg, as the pure metals or in the form of their alloys. However, particularly advantageous cathode materials are graphite, carbon and graphite-filled plastic. Examples which may be mentioned are the commercially available electrode carbons of type LEK or EXN as supplied by Conradty, Nuremberg, West Germany, or of type DIABON N, BS 70 or P 127 from Sigri, Meitingen, West Germany or BASCODUR from Raschig, Ludwigshafen, West Germany. The carbon cathods should preferably be cleaned carefully before the electrolysis, for example by rinsing them with concentrated hydrochloric acid and/or by brushing them with pure quartz powder. The carbon electrodes, which are usually porous, should preferably be stored in distilled water. The current efficiency can be increased by depositing a very thin layer, namely from 1 to 1,000 atom layers, preferably from 30 to 100 atom layers, of certain metals, such as Hg, Pb, Cu, Ag, or Au, individually or as mixtures, on the cathode prior to the electrolysis. For this purpose, the electrodes, in the readyassembled cell, are dipped into a dilute acidified aqueous solution of the corresponding metal salts such as $Pb(NO_3)_2$, $HgSO_4$, $CuSO_4$, $AgNO_3$ or $AuCl_3$, and the metal is deposited at current densities of from 0.1 to 1 A/dm$^2$ for the calculated period of time. whilst circulating the solution. The metals are more probably distributed over the surface as islands at selected points than as a coherent layer.

The current density used in the process according to the invention is not critical and is, for example, from 0.1 to 100 A/dm$^2$, preferably from 5 to 25 A/dm$^2$.

The temperature is suitably maintained at from 0° to 50°C. Whilst low temperatures increase the current efficiency, they entail complications. For this reason, temperatues of from 20° to 35°C are used.

When using carbon cathodes, the pH proves to have little influence and can be selected to be from 1 to 14. The pH in the catholyte is regulated by adding a dilute acid.

Good convection of the catholyte is advantageous and is achieved by, for example, circulatory pumping. The rate of flow parallel to the cathode is preferably set to values of from 0.1 to 50 cm per second.

It is advisable to use the following procedure when working up the catholyte:

First, the catholyte is adjusted to a neutral pH. The unconverted acetone and the isopropanol formed are stripped off under reduced pressure, together with part of the water. The sump material which remains is cooled to 0°C whilst stirring, if necessary after addition of water. Pinacol hexahydrate crystallizes out; this material can easily be filtered off or centrifuged oof, and is washed with a little ice water. The mother liquor is extracted with ether or methylene chloride to remove water-soluble by-products, for example the unsymmetrical dimer 2-methylpentane-2,4-diol. The conducting salt solution which remains can be recycled to the electrolysis.

For continuous conversion of the catholyte, the catholyte enriched in pinacol is continuously discharged from the cell and worked up as described above. At the same time, the acetone-rich starting solution is fed continuously to the cell.

Current efficiencies based on pinacol of more than 65% can be achieved in the process of the invention. These current efficiencies surpass the values hitherto quoted in the literature for the synthesis of pinacol, namely 37% (U.S. Pat. No. 2,485,258) and 44% (U.S. Pat. No. 2,422,468).

The process according to the invention can be carried out batchwise or continuously. In continuous operation, the reaction mixture is circulated continuously through the cell (and, preferably, through a heat exchanger), or is passed through a cascade of cells.

In addition to the high current efficiency, the process according to the invention has yet other advantages over the known processes. Thus the production of salts, which is unavoidable when the acids are neutralized, is avoided. Since the solutions contain relatively little water, only little energy is required to concentrate the material issuing from the electrolysis.

EXAMPLE 1

A rectangular plate and frame cell consists of a cathode plate, a cation exchange membrane, an anode end plate of lead coated with lead dioxide, the two frames for the electrolyte chamber, consisting of polypropylene (the cathode chamber frame possesses connections for feeding and discharging the catholyte, on the upper and lower narrow sides respectively) and PERCUNAN gaskets. The components of the cell are assembled similarly to a filter press. The catholyte is circulated, passing over a heat exchanger. The catholyte must not come into contact at any point with metals other than the cathode surface, since traces of foreign metals, such as Fe, Cu, Ni or Cr, are detrimental to the yield of product. The anolyte is cooled by means of a cooling coil in the anode chamber. The catholyte is in communication with the atmosphere via a brine-cooled off-gas pipeline. In the cell in question, the free cathode surface area is 2.5 dm$^2$ and the spacing between the cathode surface and the membrane surface is 0.6 cm.

At the beginning of the electrolysis, the anode chamber is filled with 5% strength sulfuric acid, 1 kg of a mixture of 80% by weight of technical acetone, 13% of distilled water and 7% of tetraethylammonium ethylsulfate ($NEt_4$. $EtSO_4$) is introduced into the catholyte circulation system. The catholyte is circulated by means of a glass rotary pump at a rate corresponding to a velocity of 8 cm/sec. at the cathode. The Joule's heat generated during the electrolysis is extracted from the system by a water-cooled heat exchanger so that the temperature is kept at 25°C. The electrolysis is carried out with a current of 25 A, corresponding to a current density of 10 A/dm$^2$.

During the electrolysis, the cell potential rises from 19 to 24 volt. The pH in the catholyte is kept weakly acid by adding a little dilute sulfuric acid. Distilled water is fed in portions into the anode chamber to compensate for losses of water through electroosmosis. After the passage of 129.5 ampere hours, corresponding to an electrolysis time of 5.18 hours and a theoretical conversion of 35%, the electrolysis is discontinued.

After stripping off the low-boiling components in a rotary evaporator at room temperature under the vacuum from a water pump, 100 g of water are added to the residue and the mixture is cooled to 0°C whilst stirring. The crystals are washed with a little water and weighed as crude crystals. The pinacol is determined by analysis of the water or of the pinacol, respectively by a Karl Fischer titration or by gas chromatography. The composition of the crystals corresponds approximately to that of pinacol hexahydrate (theoretical value 52.3% of pinacol). Analysis for N and S shows that in all cases less than 1% of the conducting salt employed is retained in the crude crystals.

The mother liquor is extracted with ether in a continuous extractor. The ether extract (averaging from 5 to 30 g) contents, in addition to pinacol (averaging from 10 to 20%), principally 2-methylpentane-2,4-diol (averaging from 20 to 70%), but no pinacolone. The pinacol is taken into account in calculating the current efficiencies. Analysis for N and S shows that less than 0.5% of the conducting salt employed passes into the ether extract. Analysis, for N and S, of the extracted mother liquor shows that more than 90% of the conducting salt employed are recovered therein. The isopropanol formed is determined directly in the catholyte by gas chromatography.

Table I lists the current efficiencies achieved, as a function of the cathode material.

Table 1

| Cathode | Crude crystals g | Crude crystals % of pinacol | Crude crystals % of water | Ether extract g of pinacol | Current efficiency (%) pinacol | Current efficiency (%) isopropanol | Current efficiency (%) 2-methylpentane-2,4-diol |
|---|---|---|---|---|---|---|---|
| Graphite (DIABON N) | 405 | 50 | 52.4 | 3.8 | 67.3 | 22.4 | 5.6 |
| DIABON N with 100 atom layers of mercury | 364 | 52 | 52.7 | 3.7 | 67.5 | 31.1 | 6.5 |
| DIABON N with 100 atom layers of copper | — | — | — | 3.0 | 1.1 | 25.9 | — |
| Very pure lead | 266 | 51 | 52.0 | 3.0 | 48.7 | 13.0 | 2.4 |
| Copper | 358 | 55 | 49.5 | 1.9 | 69.8 | 19.7 | 2.7 |
| Copper, leaded, according to U.S. 2,422,468 | 415 | 55 | 50 | 2.4 | 81.1 | 17.2 | 6.0 |
| DIABON N, electrolyte containing sulfuric acid | 199 | 14 | 86 | 0.4 | 9.2 | *) | — |
| Lead, electrolyte containing sulfuric acid | — | — | — | 6.9 | 2.4 | *) | — |

*) The isopropanol was not determined.

The results show that using the process according to the invention, pinacol is obtained in current efficiencies of 70 to 80%. Surprisingly, a polished copper plate proves to be an advantageous cathode whilst a copper-coated graphite plate does not. The two experiments with electrolyte containing sulfuric acid (7% of $H_2SO_4$ instead of 7% of $NEt_4.EtSO_4$), carried out for comparison, show that under these known reaction conditions the current efficiency decreases very strongly.

EXAMPLE 2

The catholyte described in Example 1, containing 7% of $NET_4$. $EtSO_4$, is converted in 1.5 kg batches in the plate and frame cell described in Example 1, under the conditons described there and employing a DIABON N cathode. The running time per batch is 7 hours and 47 minutes, for 35% theoretical conversion. The cathode is not cleaned between the individual batches; during the pauses of approx. 16 hours duration between electrolyses, the cathode chamber is filled with distilled water.

Table 2 gives the results of the individual batches, in time sequence.

Table 2

| Batch No. | Crude crystals | Crude crystals % of pinacol **) | Crude crystals % of water | Ether extract g of pinacol | Current efficiency (%) pinacol | Current efficiency (%) isopropanol | Current efficiency (%) 2-methylpentane-2,4-diol |
|---|---|---|---|---|---|---|---|
| 1*) | 189.4 | 48 | | 17.1 | 25.3 | 30.7 | 7.3 |
| 2 | 596 | 46 | | 12.5 | 67.1 | 20.2 | 9.5 |
| 3 | 635 | 44 | | 10.5 | 67.9 | 19.4 | 9.1 |
| 4 | 609 | 44 | 57.8 | 15.6 | 66.4 | 20.2 | 8.1 |
| 5 | 582 | 38 | 55.8 | 15.8 | 55.5 | 23 | 9.0 |
| 6 | 578 | 40 | 58 | 16.3 | 58 | 22 | 10.7 |
| 7 | 532 | 40 | 58.1 | 19.6 | 54.3 | 26.2 | 9.8 |
| 8 | 533 | 39 | | 21.1 | 53.6 | 21.5 | 6.7 |
| 9 | 577 | 35 | | 12.6 | 50.2 | 25.2 | 6.0 |
| 10 | 497 | 47 | | 6.92 | 56.3 | 43 | 6.3 |
| 11 | 468 | 36 | | 4.2 | 40.4 | 25.4 | 9.6 |
| 12 | 406 | 48 | | 7.9 | 47.5 | 25.1 | 6.6 |
| 13 | 554 | 39 | 58.7 | 4.5 | 51.6 | 28.8 | 9.1 |
| 14 | 503 | 37 | 55.5 | 6.7 | 45.8 | 28.3 | 9.4 |

*) The cell was contaminated with traces of copper

**) Lower pinacol contents in the crystals caused by more intensive washing.

Thus, the activity of the cathode decreases only slightly with time. An analogous series of experiments with a lead-coated copper cathode (See Table 1) showed, entirely analogously, that the results were only slightly dependent on time. In these experiments, the cathode chamber was covered with acetone between experiments, to prevent corrosion of the lead. In contrast, the activity of the same cathode in an electrolyte containing sulfuric acid decreases greatly even within 24 hours; of U.S. Pat. Nos. 2,422,468 and 2,485,258 and O. C. Slotterbeck, Trans. electrochem. Soc. 92, 377 (1947).

We claim:

1. A process for the manufacture of pinacol by electrolytic hydrodimerization of acetone in a compartmented cell, using an anode of lead, graphite or titanium, such anode being coated with lead dioxide, and as cathode material a metal of medium or high hydrogen overvoltage at a temperature of from 0° to 50°C, wherein the catholyte used for the electrolysis contains from 10 to 90% by weight of acetone, from 1 to 60% by weight, of water and from 1 to 50% by weight of quaternary ammonium salt.

2. A process as claimed in claim 1, wherein the catholyte contains from 40 to 80% by weight of acetone, from 5 to 40% by weight of water and from 5 to 20% by weight of a quaternary ammonium salt.

3. A process as claimed in claim 1, wherein the cathode consists of graphite, carbon or graphite-filled plastic.

4. A process as set forth in claim 4 wherein said quaternary ammonium salt has the formula

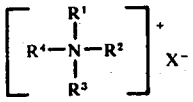

wherein $R^1$, $R^2$, $R^3$, and $R^4$ are identical or different and are selected from the group consisting of alkyl of 1 to 6 carbon atoms, phenyl and benzyl and $X^-$ is an anion.

5. A process as set forth in claim 4 wherein said anion is a sulfate, alkyl-sulfate, phosphate, carbonate, tosylate, tetrafluoborate, hexafluosilicate, halide or perchlorate.

6. A process as set forth in claim 4 wherein said metal is selected from the group consisting of Cu, Ag, Cd, Zn, Sn, Pb, Tl, Hg, graphite, and carbon and graphite-filled plastic.

7. A process as set forth in claim 1 wherein said compartmented cell has a porous diaphragm as a partition.

8. A process as set forth in claim 1 wherein said cell is divided by a sulphonated cross-linked polystyrene cation exchange member.

* * * * *